US005551346A

United States Patent [19]

Walters et al.

[11] Patent Number: 5,551,346

[45] Date of Patent: Sep. 3, 1996

[54] APPARATUS FOR DISPERSING A JET FROM A SHAPED CHARGE LINER VIA NON-UNIFORM LINER MASS

[75] Inventors: William Walters, Elkton; Richard Summers, Conowingo, both of Md.

[73] Assignee: The United States of America as represented by the Secretary of the Army, Washington, D.C.

[21] Appl. No.: 543,972

[22] Filed: Oct. 17, 1995

[51] Int. Cl.[6] ..... F42B 12/10

[52] U.S. Cl. ..... 102/476; 102/306

[58] Field of Search ..... 102/306–310, 102/476

[56] References Cited

U.S. PATENT DOCUMENTS

| | | | |
|---|---|---|---|
| H33 | 3/1986 | Jameson et al. | 102/476 |
| 3,146,711 | 9/1964 | Schaadt et al. | 102/476 |
| 3,217,650 | 11/1965 | Paul et al. | 102/476 |
| 3,218,975 | 11/1965 | Massey | 102/476 |
| 3,726,224 | 4/1973 | Pugh et al. | 102/476 |
| 3,732,818 | 5/1973 | Thomanek | 102/306 |

*Primary Examiner*—Harold J. Tudor

*Attorney, Agent, or Firm*—Freda L. Krosnick; Paul S. Clohan

[57] ABSTRACT

The jet of a shaped charge ammunition round may be disrupted and dispersed by altering the local charge to mass ratio within the shaped charge round. A shaped charge round typically produces a coherent jet suitable for penetrating thick armor or the like. However, such coherent jets may be unsuitable for damaging thinner targets. By placing a mass (or removing a mass) at a local portion of the shaped charge liner, the outer casing, or the explosive charge, the local charge to mass ratio may be altered, causing disruption of the coherent jet. A wire, wrapped around the charge liner in a spiral fashion, may be used to produce a substantially helical or spiral shaped jet which may be particularly applicable for damaging missiles or the like.

5 Claims, 4 Drawing Sheets

APPARATUS FOR DISPERSING A JET FROM A SHAPED CHARGE LINER VIA NON-UNIFORM LINER MASS

STATEMENT OF GOVERNMENT INTEREST

The subject matter of the present application was developed by employees of the U.S. Government, Department of the Army, Army Research Laboratory, in the course of their employment. The U.S. Government has a paid-up license in this invention and the right to require the patent owner to license others on reasonable terms.

CROSS-REFERENCE TO RELATED APPLICATIONS

The subject matter of this application is related to that disclosed in copending applications Ser. Nos. 08/544,082 filed Feb. 14, 1996, and 08/543,973 filed Oct. 17, 1995

FIELD OF THE INVENTION

The present invention relates to a method and apparatus for dispersing a jet from a shaped charge liner in an ammunition round to provide a wider impact area against large targets.

BACKGROUND OF THE INVENTION

Shaped charge designs in present use (i.e., in weapon systems, oil well completion, or drilling operations) may be designed to provide a deep hole in a target material and maximize crater volume. Such shaped charge configurations achieve maximum penetration by projecting a continuous rod or a stream of particles, in near perfect alignment, against a target material. Since penetration is directly proportional to the length of the penetrator, care is taken to maximize the jet length and to keep jet particles well aligned. This concept results in deep holes, of relatively small diameter, in a target.

However, certain applications may require attack of relatively thin targets (i.e., materials of low strength and small thicknesses). Conventional shaped charges do relatively little damage against such targets. For example, a shaped charge fired against a lightly armored vehicle will do minimal ballistic damage. The jet will perforate such a vehicle leaving only a small entrance and exit hole. Against targets of this type, it may be advantageous to reduce the effective depth of penetration and spread the impacting penetrator jet over a wider surface area to maximize the total damage to the target. This type of damage may be obtained by dispersing the jet in a radial fashion to increase the surface area impacted by the jet.

In addition, it may be desirable to provide a particular jet pattern for particular types of targets. For example, when using a shaped charge to destroy a missile or the like, a particular pattern may be desirable to insure that at least a portion of the penetrator jet impacts the missile.

Moreover, it may be desirable to provide a shaped charge round which may be selectively provided with either aligned and dispersed jets. The use of a single round type to provide both types of charges may reduce inventory costs significantly and allow for selection, in the field, of charge type for a given round. In addition, the use of a same or similar charge type for both aligned and dispersed jets may reduce manufacturing costs of such charges due to the economies of scale in manufacturing a common charge design.

FIG. 1 is a cross section view of a prior art shaped charge round. Explosive fill 10 within casing 24 surrounds a hollow cavity made by liner 15. Casing 24 may comprise a metallic (e.g., thin aluminum or steel) or non-metallic (e.g., composite graphite, plastic, cardboard or the like). Alternatively, no casing may be provided for example, for a static charge fired from a stationary position.

Liner 15 is illustrated in FIG. 1 as a conical insert with a thin wall although any arcuate geometry may be used depending on desired result. Casing 24 may be a regular cylinder or may take other forms (e.g., tapered or boat-tailed cylinder). The shaped charge round of FIG. 1 may be typically point initiated by a booster/detonator assembly 18 located along an axis of revolution of the round.

The shaped charge round of FIG. 1 may be incorporated into an artillery shell, mortar shell, missile (e.g., surface to air missile, wire guided missile, air to air missile, or the like) or may be incorporated into charges used for industrial purposes (e.g., oil exploration, mining, explosive welding, or the like).

Once the round of FIG. 1 has been detonated, liner 15 collapses to form a high speed jet. The use of liner 15 is described, for example, in H. Mohaupt, U.S. Pat. No. 2,419,414, issued Apr. 22, 1947, incorporated herein by reference.

SUMMARY AND OBJECTS OF THE INVENTION

A method is provided for altering a shaped charge round so as to disrupt and disperse a jet from a shaped charge round so as to increase damage area to a target. A shaped charge round is provided having an outer casing, an explosive charge provided within the outer casing, and a shaped charge liner provided within the outer casing. The mass of the shaped charge round is altered so as to locally alter charge to mass ratio so as to alter the collapse of the shaped charge liner upon detonation in a non-axisymmetric manner at certain regions of the shaped charge liner.

The mass of the shaped charge round may be altered by attaching mass to an outer surface of the shaped charge liner, adding mass to an outer surface of a casing of the shaped charge round, or adding mass to the explosive fill of the shaped charge round. A mass may be attached to the shaped charge liner in a predetermined configuration so as to produce a desired jet dispersement and shape. The mass may comprise a wire mass wrapped in a spiral around the shaped charge liner.

Alternately, or in addition, the mass of the shaped charge round may be altered by removing explosive mass from the shaped charge round in an asymmetric manner, removing casing mass from a shaped charge round in an asymmetric manner, or removing liner mass from a shaped charge round in an asymmetric manner.

A shaped charge round is provided having a disrupted and dispersed jet. The shaped charge round includes a substantially cylindrical outer casing. An explosive charge is provided within the outer casing. A shaped charge liner is provided within the outer casing. The mass of the shaped charge round has been altered so as to locally alter charge to mass ratio so as to alter the collapse of the shaped charge liner upon detonation in a non-axisymmetric manner at certain regions of the shaped charge liner.

The mass of the shaped charge round may be altered by adding mass to an outer surface of the shaped charge liner, the outer surface of the casing of the shaped charge round, or the explosive charge of the shaped charge round.

The mass may be attached to the shaped charge liner in a predetermined configuration so as to produce a desired jet dispersement and shape. The mass may comprise a wire mass wrapped in a spiral around the shaped charge liner.

Alternately, or in addition, the mass of the shaped charge round may be altered by removing explosive mass from the shaped charge round in an asymmetric manner, removing casing mass from a shaped charge round in an asymmetric manner, or by removing liner mass from a shaped charge round in an asymmetric manner.

It is an object, therefore, of the present invention, to disperse the jet of a shaped charge round into a dispersed jet.

It is a further object of the present invention to disperse the jet of a shaped charge round into a dispersed jet of a predetermined pattern.

It is a further object of the present invention to provide an inexpensive and readily implemented apparatus for dispersing the jet of a shaped charge round.

It is a further object of the present invention to provide a round design having common elements for a shaped charge having an aligned jet and dispersed jet applications.

Still other objects and advantages of the present invention will become readily apparent to those skilled in this art from the following detailed description, wherein only the preferred embodiment of the invention is shown and described, simply by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

BRIEF DESCRIPTIONS OF THE DRAWINGS

DETAILED DESCRIPTION OF THE INVENTION

Figure 1:
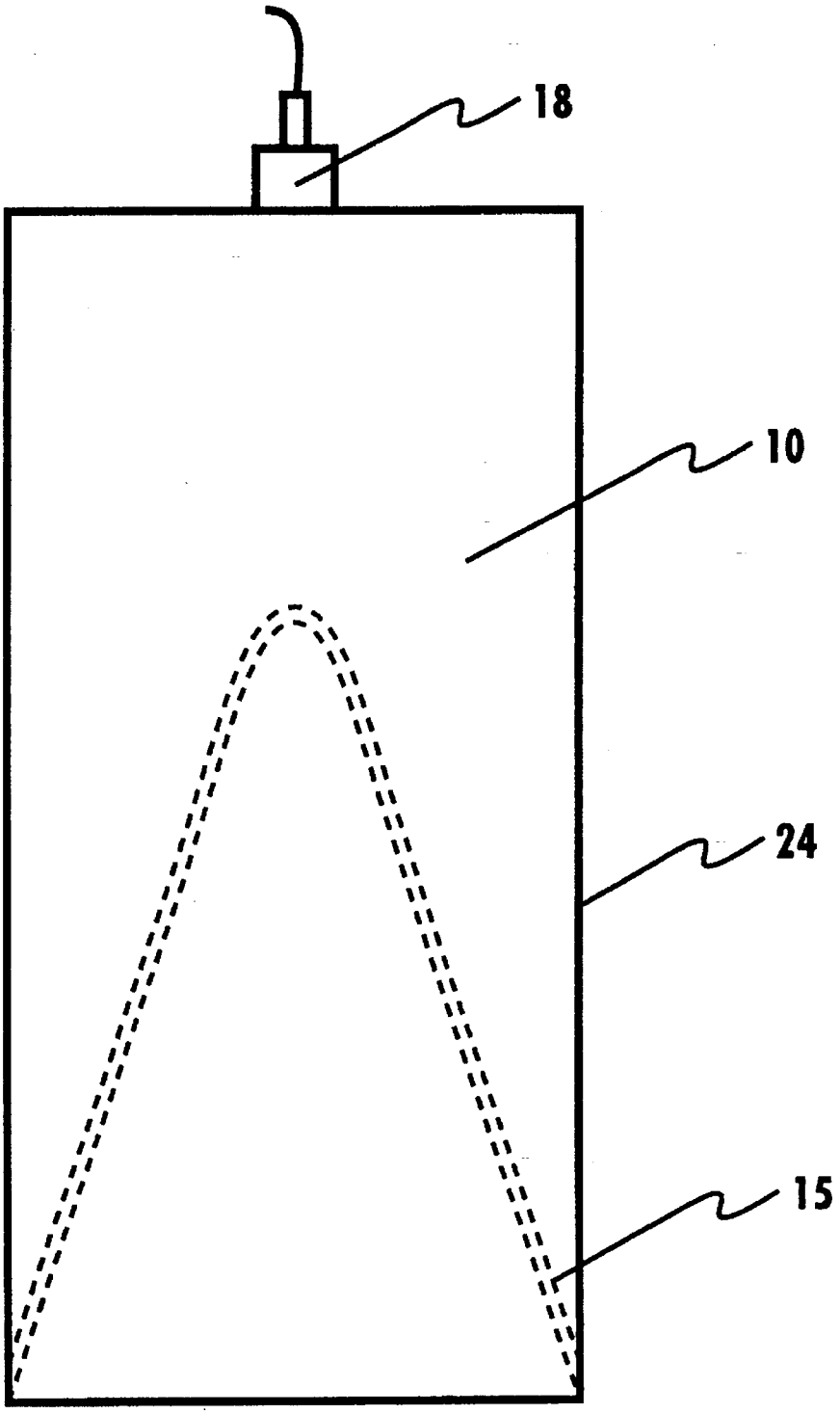
Fig. 1 (PRIOR ART)
FIG. 1 is a side view of a prior art shaped charge illustrating the charge liner in dashed lines.
Figure 2:
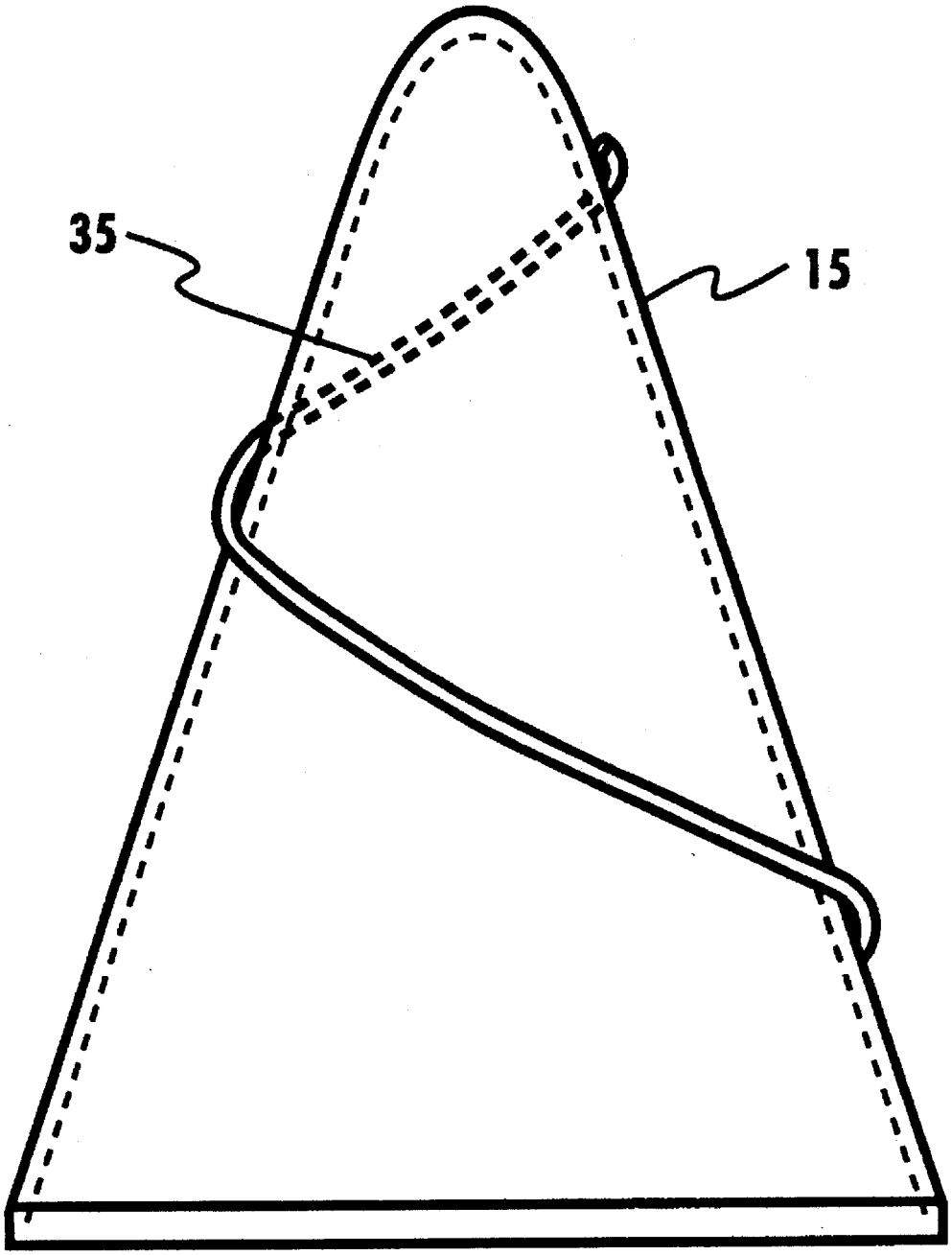
FIG. 2 is a side view of a charge liner incorporating the jet dispersement mechanism of the present invention.

Referring now to FIG. 2, in the apparatus of the present invention, wire 35 is wrapped around the outside surface of liner 15, which, for the purposes of illustration is shown as a conical liner. Wire 35 may be wrapped in a spiral fashion around the circumference of liner 15. The geometry of the wrap, or trace of wire 35 along liner 15, may be varied to intensify jet disturbance or alter the resulting jet pattern.

In the embodiment of FIG. 2, the spiral wire wrap may produce a jet pattern resembling a sine waveform. Such a jet pattern may be particularly useful, for example, in targeting missiles or the like, where aiming of the patterned jet is desired, but a random dispersement of the jet may be undesirable.

In general, the greater the surface area of liner 15 covered by wire 35, the greater the disturbance to the resulting jet. In addition, the diameter of wire 35 will have an effect on jet disturbance. In other words, the greater the wire diameter, the larger the perturbation to the jet. In the preferred embodiment, as experimentally investigated, a relatively thick 12 gauge wire 35 was wrapped in a spiral fashion around the outside of a conical copper liner 15, although other gauge wires may be used without departing from the spirit and scope of the present invention. Similarly, although a round wire is disclosed here, other wires having different cross-sectional shapes may also be used.

Wire 35 may be copper, although dissimilar materials may also be used. Wire 35 may be attached to liner 15 by soft-soldering wire 35 at one end point and wrapping wire 35 in a desired fashion (e.g., helical). The remaining free end of wire 35 may also be spot soldered to liner 15. Caulk (not shown) chemically compatible with the explosive to be used may be employed to provide a barrier between wire 35 and liner 15. Caulk may prevent the explosive from flowing between wire 35 and liner 15.

In addition, the bridge (or raised area) formed by caulk around wire 35 may allow for the smooth flow of cast explosive around wire 35 and prevents voids from forming near the interface of wire 35 and liner 15. In the preferred embodiment, as performed experimentally, an RTV caulk and a 70/30 Octol high explosive may be used. In one test, conducted at Experimental Range Facility No. 16, round No. 4592, the dispersed jet impacted and damaged an area 330×160 mm in a sample target. Typically the same liner 15 without wire 35 may create a damage area in a sample target of 35 mm in diameter. In such tests, the sample target was armor steel plate.

Other techniques may be used to attach wire 35 to liner 15. For example, the entire length (or portion thereof) of wire 35 may be soldered to liner 15. Alternately, or in addition, wire 35 may be glued to liner 15. Liner 15 may alternately be machined with raised areas to simulate the presence of wire 35. Wire 35 may be taped to liner 15.

Another experiment of the present invention utilized a copper, conical liner 15 with a thin wire 35 (e.g., 1/32 inch diameter) attached to liner 15 using aluminum tape. This test involved a half spiral wrap of wire 35 around liner 15. In this test, the resulting jet was disturbed, but not nearly to the extent when using a thick (12 gauge) wire 35 using a full wrap. In this latter test, at Experimental Range Facility No. 16 Round No. 4593, a damage or impact area of 121×121 mm was created against an armor steel plate. The results of these two tests indicate a degree of control over the process. Thus, for example, larger or smaller sized wires, wrap lengths, and the like may be used to vary jet dispersement and pattern to desired parameters.

Figure 3:
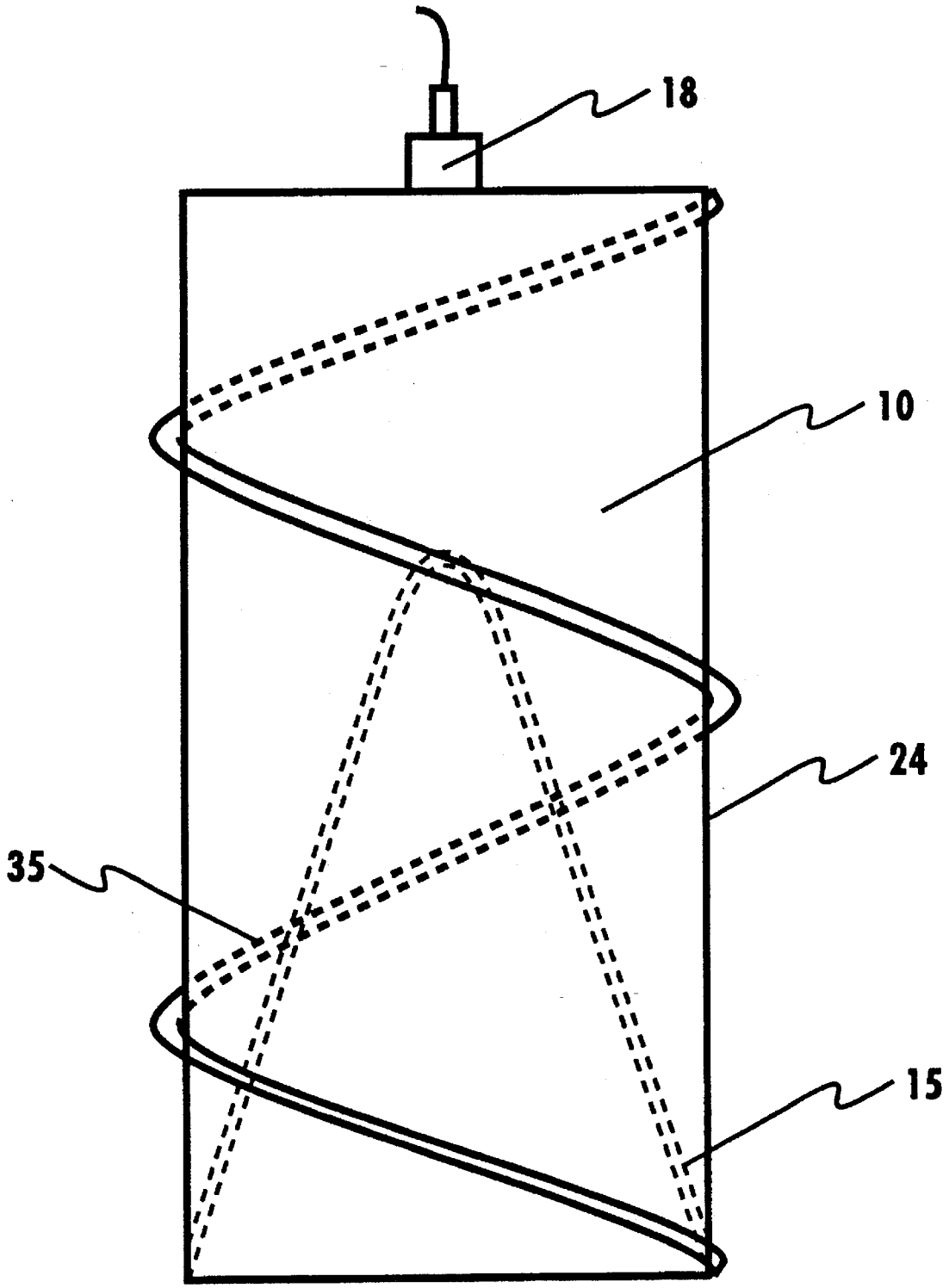
FIG. 3 is a first alternative embodiment of the present invention.
Figure 4:
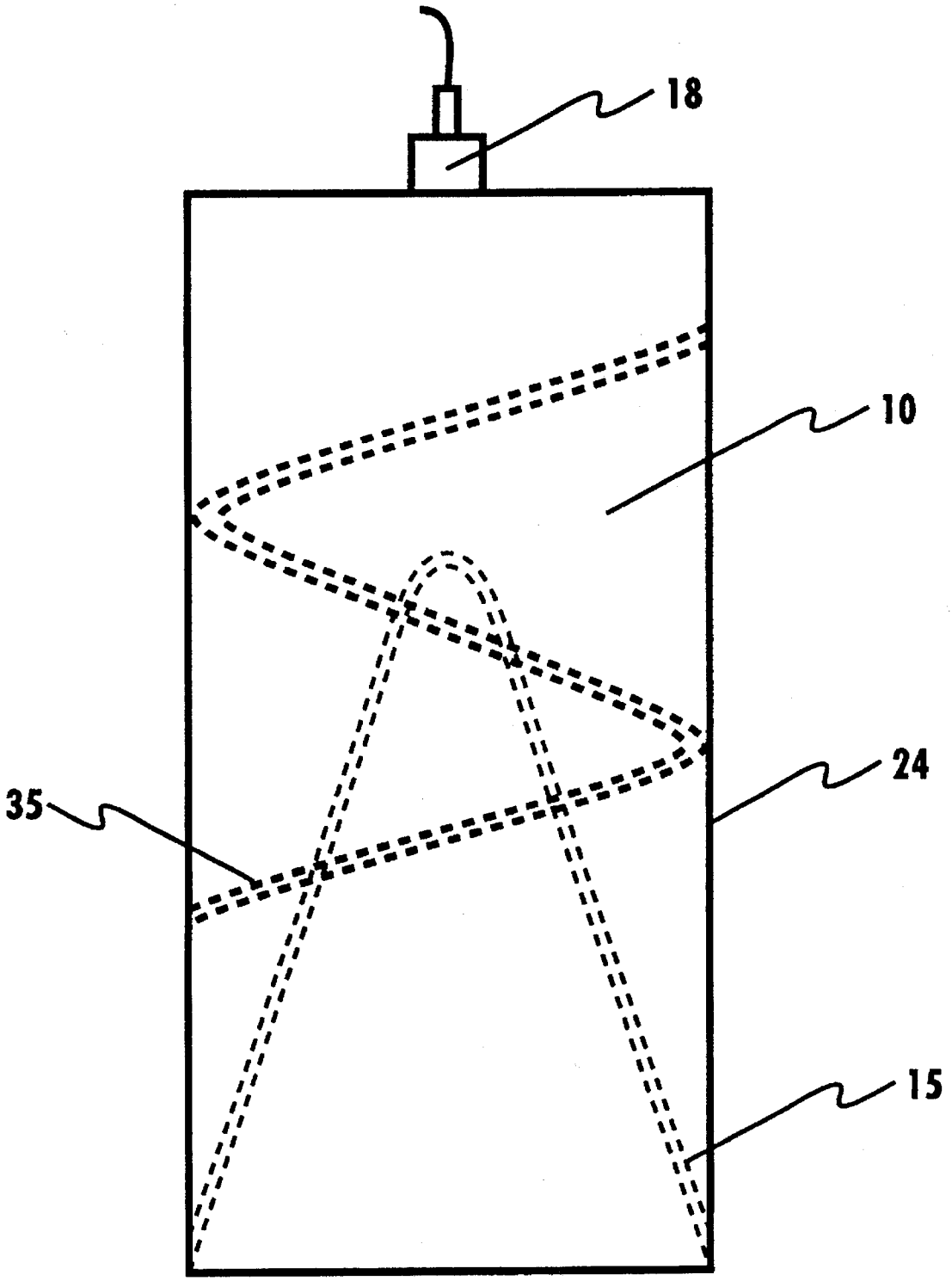
FIG. 4 is a second alternative embodiment of the present invention.

A similar effect may be achieved by wrapping wire 35 around casing 24 housing explosive 10 as illustrated in FIG. 3 to adjust the tamping of the round. Alternatively, casing 24 may be machined to remove mass to leave a raised portion 35, or a groove, notch or other area may be similarly removed by machining or the like. In a similar manner, a raised portion 35 or groove may be formed in shaped charge liner 15 using machining or casting techniques to alter the local mass to charge ratio. In another embodiment, wire 35 may be placed within explosive fill 10, or element 35 of FIG. 4 may represent a void which may be formed within explosive fill 10 so as to alter local mass/charge distribution.

In all embodiments, the fundamental concept is to locally alter the charge to mass ratio (i.e., the ratio of the explosive mass to metal mass) to alter the collapse in a non-axisymmetric manner at certain regions of liner 15. This may be accomplished by altering either the explosive geometry, the metal geometry, or both. In other words, the explosive may be a symmetric or the liner metal may be a symmetric. The alteration of the geometry entails either adding or subtracting metal or explosive mass. Also, mass may be added to the liner by means other than a wire such as a tape or any geometry in addition to flat (tape) or round (wire).

It will be readily seen by one of ordinary skill in the art that the present invention fulfills all of the objects set forth above. After reading the foregoing specification, one of ordinary skill will be able to effect various changes, substitutions of equivalents and various other aspects of the invention as broadly disclosed herein. It is therefore intended that the protection granted hereon be limited only by the definition contained in the appended claims and equivalents thereof.

While the preferred embodiment and various alternative embodiments of the invention have been disclosed and described in detail herein, it may be apparent to those skilled in the art that various changes in form and detail may be made therein without departing from the spirit and scope thereof.

What is claimed is:

1. A shaped charge round having a disrupted and dispersed jet comprising:

a substantially cylindrical outer casing;

an explosive charge provided within the outer casing; and a shaped charge liner provided within the outer casing;

wherein the mass of the shaped charge round has been altered by adding a wire having circular cross section in a spiral fashion about said round so as to locally alter charge to mass ratio so as to alter the collapse of the shaped charge liner upon detonation in a non-axisymmetric manner at certain regions of the shaped charge liner so as to disperse over a wider area the resulting jet emitted by said shaped charge round.

2. The shaped charge round of claim 1 wherein the mass of the shaped charge round has been altered in a spiral fashion by adding said wire to an outer surface of the shaped charge liner.

3. The shaped charge round of claim 1 wherein the mass of the shaped charge round has been altered in a spiral fashion by adding said wire to an outer surface of the substantially cylindrical outer casing.

4. The shaped charge round of claim 1, wherein the mass of the shaped charge round has been altered in a spiral fashion adding said wire to the explosive charge of the shaped charge round.

5. The shaped charge round of claim 1, wherein said wire comprises a copper wire wrapped in a spiral around the shaped charge liner.

* * * * *